US011474472B2

(12) United States Patent
Harada et al.

(10) Patent No.: US 11,474,472 B2
(45) Date of Patent: Oct. 18, 2022

(54) IMAGE CARRYING MEMBER UNIT AND IMAGE FORMING APPARATUS THEREWITH

(71) Applicant: KYOCERA Document Solutions Inc., Osaka (JP)

(72) Inventors: Yuzo Harada, Osaka (JP); Masahiro Ueno, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 17/377,212

(22) Filed: Jul. 15, 2021

(65) Prior Publication Data

US 2022/0026841 A1 Jan. 27, 2022

(30) Foreign Application Priority Data

Jul. 21, 2020 (JP) ..... JP2020-124252

(51) Int. Cl.
*G03G 15/00* (2006.01)
*G03G 21/16* (2006.01)

(52) U.S. Cl.
CPC ..... *G03G 15/75* (2013.01); *G03G 21/1652* (2013.01)

(58) Field of Classification Search
CPC ..... G03G 15/75; G03G 15/80; G03G 21/1652
USPC ..... 399/116, 117
See application file for complete search history.

(56) References Cited

U.S. PATENT DOCUMENTS 6,249,661 B1 * 6/2001 Saitoh ..... G03G 15/751 399/117
10,185,279 B1 * 1/2019 Sadik ..... G03G 15/75

FOREIGN PATENT DOCUMENTS

JP 2007-298909 A 11/2007
JP 2011-197541 A 10/2011

* cited by examiner

*Primary Examiner* — Hoan H Tran
(74) *Attorney, Agent, or Firm* — Stein IP, LLC

(57) ABSTRACT

An image carrying member unit includes an image carrying member, a flange member, a shaft member, and a grounding member. The grounding member has a first bottom plate portion electrically connecting to the shaft member, and a pair of flat spring portions. Each flat spring portion has a first spring segment and a second spring segment bent from the tip end of the first spring segment via a second bent portion outward in the radial direction of the image carrying member to extend to approach the first bottom plate portion. Before insertion in the image carrying member, the distance between the second bent portions of the flat springs is smaller than the inner diameter of the image carrying member and the distance between tip end parts of the second spring segments is larger than the inner diameter of the image carrying member.

11 Claims, 10 Drawing Sheets

IMAGE CARRYING MEMBER UNIT AND IMAGE FORMING APPARATUS THEREWITH

INCORPORATION BY REFERENCE

This application is based on and claims the benefit of Japanese Patent Application No. 2020-124252 filed on Jul. 21, 2020, the contents of which are hereby incorporated by reference.

BACKGROUND

The present disclosure relates to image forming apparatuses such as copiers, printers, and facsimile machines. More particularly, the present disclosure relates to image carrying member units that include an image carrying member for carrying an electrostatic latent image, and to image forming apparatuses that incorporate such an image carrying member.

On known image forming apparatuses that employ an electrophotographic process, an electrostatic latent image is formed on an image carrying member that is electrostatically charged uniformed, and the electrostatic latent image is developed into a toner image to form an image on a sheet (recording medium).

Such image forming apparatuses incorporate an image carrying member unit that has a structure for diverting the electric charge retained on the body of an image carrying member to the body of the image forming apparatus with the aim of keeping a constant amount of electric charge present on the surface of the image carrying member.

SUMMARY

According to one aspect of the present disclosure, an image carrying member unit includes an image carrying member, a flange member, a shaft member, and a grounding member. The image carrying member is in a cylindrical shape, has a photosensitive layer formed on its outer circumferential surface thereof, and has an opening at each end of it. The flange member is electrically non-conductive, has a fitting portion fitted in the opening in the image carrying member and a through-hole along the rotation center of the image carrying member, and is fixed to each end of the image carrying member. The shaft member is inserted in the through-hole in the flange member. The grounding member is fixed to the flange member, and electrically connects together the image carrying member and the shaft member. The grounding member has a first bottom plate portion fixed to a tip end part of the fitting portion in its fitting direction and a pair of flat spring portions rising from the first bottom plate portion via a first bent portion in the fitting direction and facing each other in the radial direction of the image carrying member orthogonal to the fitting direction. The first bottom plate portion has a first projection portion extending toward the through-hole so as to approach and electrically connect to the shaft member. The flat spring portions each has a first spring segment extending from the first bent portion in the fitting direction and a second spring segment bent from the tip end of the first spring segment via a second bent portion outward in the radial direction of the image carrying member to extend in the direction opposite to the fitting direction so as to approach the first bottom plate portion. Before insertion in the image carrying member, the distance between the second bent portions of the flat spring portions is smaller than the inner diameter of the image carrying member, and the distance between tip end parts of the second spring segments is larger than the inner diameter of the image carrying member.

DETAILED DESCRIPTION

Figure 1:
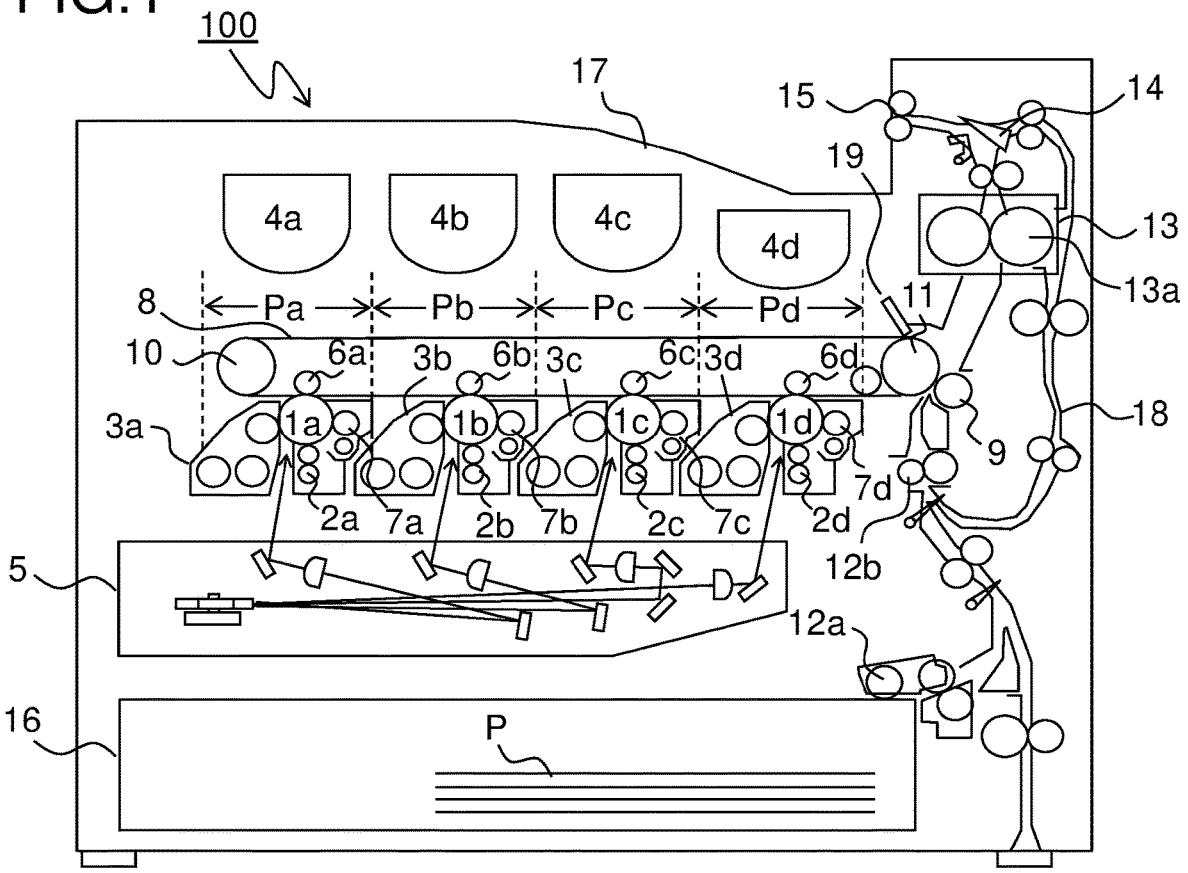
FIG. 1 is a sectional view showing an outline of the construction of an image forming apparatus according to a first embodiment of the present disclosure.
Figure 2:
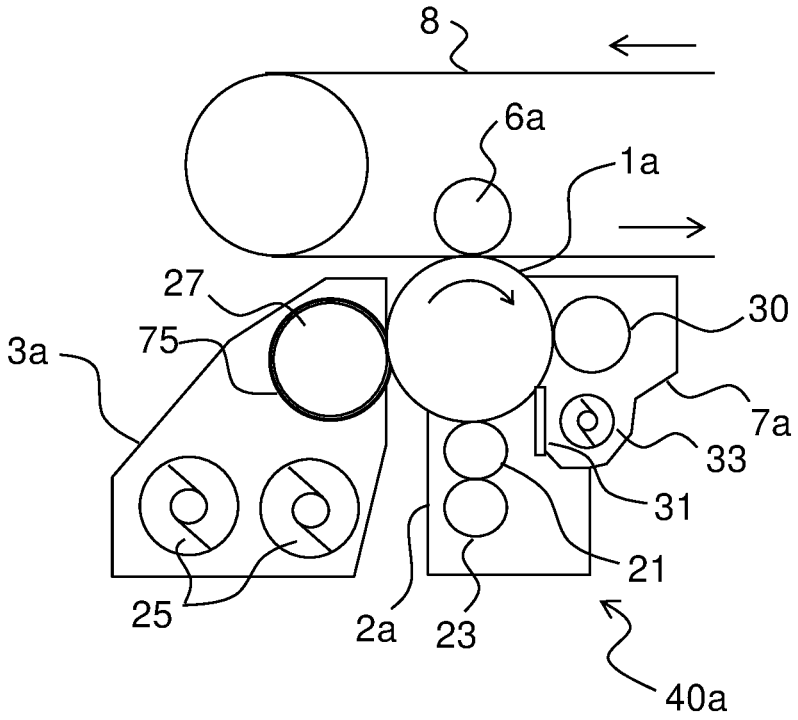
FIG. 2 is an enlarged view around an image forming portion in FIG. 1.

Embodiments of the present disclosure will be described below with reference to the accompanying drawings. First, with reference to FIGS. 1 to 7, a drum unit according to a first embodiment will be described. FIG. 1 is a sectional view showing an outline of the construction of an image forming apparatus 100 according to the first embodiment of the present disclosure. FIG. 2 is an enlarged view around an image forming apparatus Pa in FIG. 1. In this embodiment the image forming apparatus 100 is configured as a four-stage tandem-type color printer that has four photosensitive drums 1*a*, 1*b*, 1*c*, and 1*d* corresponding to different colors (magenta, cyan, yellow, and black) arranged side by side to perform image formation.

Inside the body of the image forming apparatus 100, four image forming portions Pa, Pb, Pc, and Pd are arranged in this order from left to right in FIG. 1. These image forming portions Pa to Pd are provided to correspond to four different colors (magenta, cyan, yellow, and black), and sequentially form a magenta, a cyan, a yellow, and a black image respectively, each through the processes of electrostatic charging, exposure to light, image development, and image transfer.

The image forming portions Pa to Pd have arranged in them photosensitive drums 1*a* to 1*d*, respectively, for carrying visible images (toner images) of the different colors. Adjacent to the image forming portions Pa to Pd, an intermediate transfer belt 8 is arranged, which rotates counterclockwise in FIG. 1.

Sheets P to which toner images are to be transferred are stored in a sheet cassette 16 arranged in a lower part inside the image forming apparatus 100. The sheets P are conveyed via a sheet feed roller 12*a* and a pair of registration rollers 12*b* to a secondary transfer roller 9. Used as the intermediate transfer belt 8 is a sheet of dielectric resin, which typically is a belt with no seams (seamless belt). The intermediate transfer belt 8 and the secondary transfer roller 9 are driven to rotate by a belt driving motor (not illustrated) at a linear velocity equal to the linear velocity of the photosensitive drums 1*a* to 1*d*. Downstream of the secondary transfer roller 9, a plate-form belt cleaner 19 is arranged. The belt cleaner 19 removes toner and the like that are left behind on the surface of the intermediate transfer belt 8.

Next, the image forming portions Pa to Pd will be described. The following description deals with the image forming apparatus Pa in detail; for the image forming portions Pb to Pd, which are basically constructed similarly to the image forming apparatus Pa, no overlapping description will be repeated. As shown in FIG. 2, around the photosensitive drum 1*a*, along its rotation direction (clockwise in FIG. 2), there are arranged a charging device 2*a*, a developing device 3*a*, a cleaning device 7*a*, and, across the intermediate transfer belt 8, a primary transfer roller 6*a*.

The charging device 2*a* includes a charging roller 21 and a charging cleaning roller 23. The charging roller 21 makes contact with the photosensitive drum 1*a*, and applies a charging bias to the drum surface. The charging cleaning roller 23 cleans the charging roller 21. The developing device 3*a* includes two stirring-conveying members 25 and a magnetic roller 27 (developing roller). The stirring-conveying members 25 are composed of stirring-conveying screws and feeding-conveying screws. The magnetic roller 27 is arranged opposite the photosensitive drum 1*a*, and supplies toner to the photosensitive layer on the surface of the photosensitive drum 1*a*. The developing device 3*a* brings two-component developer (in the form of a magnetic brush) carried on the surface of the magnetic roller 27 into contact with the surface of the photosensitive drum 1*a*, and thereby develops an electrostatic latent image into a toner image.

The cleaning device 7*a* includes a rubbing roller 30, a cleaning blade 31, and a collecting spiral 33. The rubbing roller 30 is kept in pressed contact with the photosensitive drum 1*a* under a predetermined pressure. The rubbing roller 30 is driven to rotate by a drum cleaning motor (not illustrated) in the same direction as the photosensitive drum 1*a* as observed on the plane of contact between the rubbing roller 30 and the photosensitive drum 1*a*. The linear velocity of the rubbing roller 30 is controlled to be higher than (here 1.2 times as high as) the linear velocity of the photosensitive drum 1*a*.

The photosensitive drum 1*a*, the charging device 2*a*, and the cleaning device 7*a* are integrated into a unit. With respect to the image forming portions Pa to Pd, the units that have integrated in them the photosensitive drums 1*a* to 1*d*, the charging devices 2*a* to 2*d*, and the cleaning devices 7*a* to 7*d* are hereinafter referred to as drum units 40*a* to 40*d* respectively.

Next, an image formation procedure on the image forming apparatus 100 will be described. When image data is fed in from a host device such as a personal computer, first, the charging devices 2*a* to 2*d* electrostatically charge the surface of the photosensitive drums 1*a* to 1*d* uniformly. Next, an exposure unit 5 irradiates them with light based on the image data, and thereby forms electrostatic latent images based on the image data on the photosensitive drums 1*a* to 1*d*. The developing devices 3*a* to 3*d* are loaded with predetermined amounts of two-component developer containing toner of magenta, cyan, yellow, and black respectively.

As toner image formation proceeds as will be described later, when the proportion of toner in the two-component developer in the developing devices 3*a* to 3*d* falls below a prescribed value, developer is supplied from containers 4*a* dot 4*d* to the developing devices 3*a* to 3*d* respectively. The toner in the developer is supplied by the developing devices 3*a* to 3*d* onto the photosensitive drums 1*a* to 1*d* and electrostatically attaches to them, thereby forming toner images in accordance with the electrostatic latent images formed through exposure to light from the exposure unit 5.

Then the primary transfer rollers 6*a* to 6*d* apply a predetermined transfer voltage between the primary transfer rollers 6*a* to 6*d* and the photosensitive drums 1*a* to 1*d*. Thus the magenta, cyan, yellow, and black toner images on the photosensitive drums 1*a* to 1*d* are primarily transferred to the intermediate transfer belt 8. Thereafter, in preparation to the subsequent formation of electrostatic latent images, the toner left behind on the surfaces of the photosensitive drums 1*a* to 1*d* is removed by the cleaning devices 7*a* to 7*d*.

When, as a driving roller 11 is rotated by the belt driving motor (not illustrated), the intermediate transfer belt 8 starts to rotate counter-clockwise, a sheet P stored in the sheet cassette 16 in a lower part inside the body of the image forming apparatus 100 is conveyed, with predetermined timing, from the pair of registration rollers 12*b* to the nip (secondary transfer nip) between the secondary transfer roller 9, which is provided adjacent to the intermediate transfer belt 8, and the intermediate transfer belt 8. At the nip a full-color image is secondarily transferred to the sheet P. The sheet P having the toner image transferred to it is conveyed to a fixing device 13.

The sheet P conveyed to the fixing device 13, as it passes through the nip (fixing nip) in a pair of fixing rollers 13*a*, is heated and pressed, and thereby the toner images are fixed to the surface of the sheet P, forming the predetermined full-color image. The sheet P having the full-color image formed on it is, as it is (or after being distributed by a branching portion 14 into a reverse conveyance passage 18 to have images formed on both sides), discharged onto a discharge tray 17 by a pair of discharge rollers 15.

So long as the rotation directions of the photosensitive drums 1*a* to 1*d* and the intermediate transfer belt 8 and the conveyance paths for sheets P can be designed as desired, the layout inside the body of the image forming apparatus 100 may be modified freely. For example, the rotation directions of the photosensitive drums 1*a* to 1*d* and the intermediate transfer belt 8 may be reversed from those in the embodiment, and the positional relationship between the drum units 40*a* to 40*d* and the developing devices 3*a* to 3*d* may be reversed from that in the embodiment, in which case the conveyance paths for sheets P can be designed accordingly.

Figure 3:
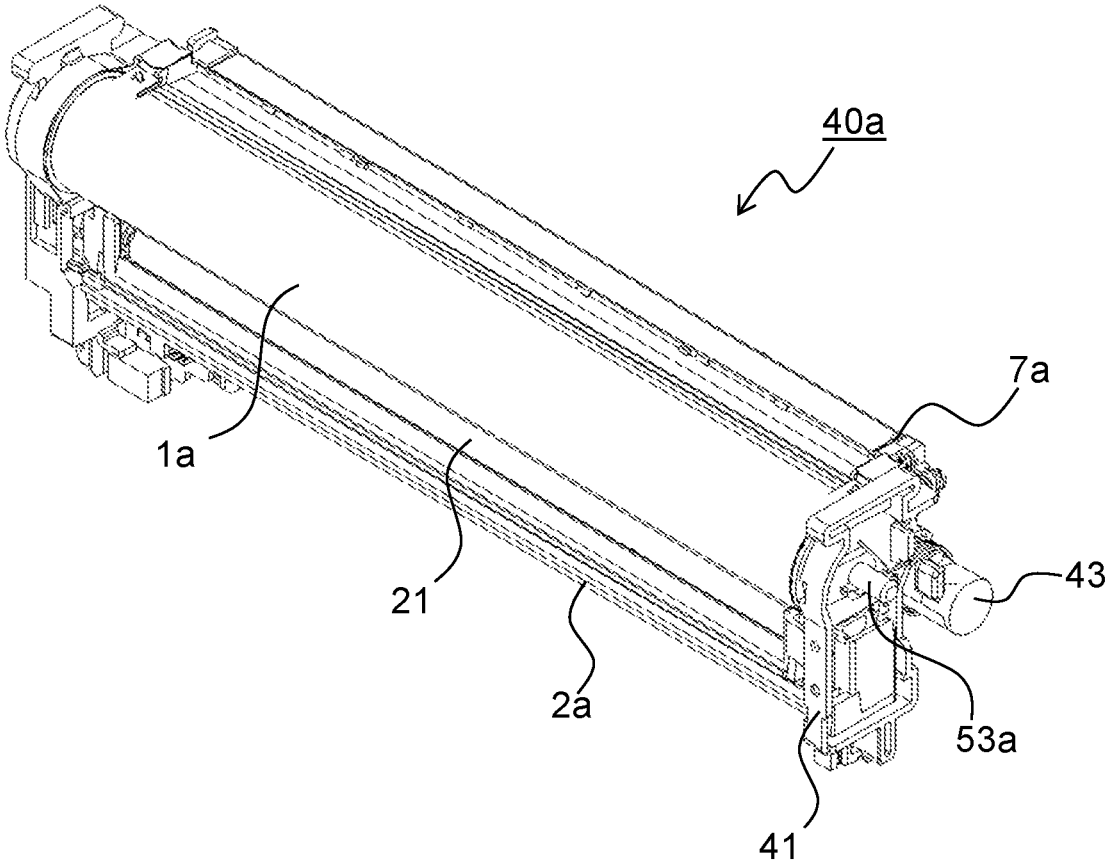
FIG. 3 is a perspective view showing a drum unit.

Next, the drum unit 40*a* will be described in detail. FIG. 3 is a perspective view showing the drum unit 40*a*. For the drum units 40*b* to 40*d*, which are basically constructed similarly to the drum unit 40*a*, no overlapping description will be repeated. As shown in FIG. 3, the drum unit 40*a* has a unit housing 41. The unit housing 41 holds the photosensitive drum 1*a*, the charging device 2*a*, and the cleaning device 7*a*. From one end side (the front-right side in FIG. 3) of the drum unit 40*a* protrudes a shaft member 53*a*, which serves as the shaft about which the photosensitive drum 1*a* rotates.

Figure 4:
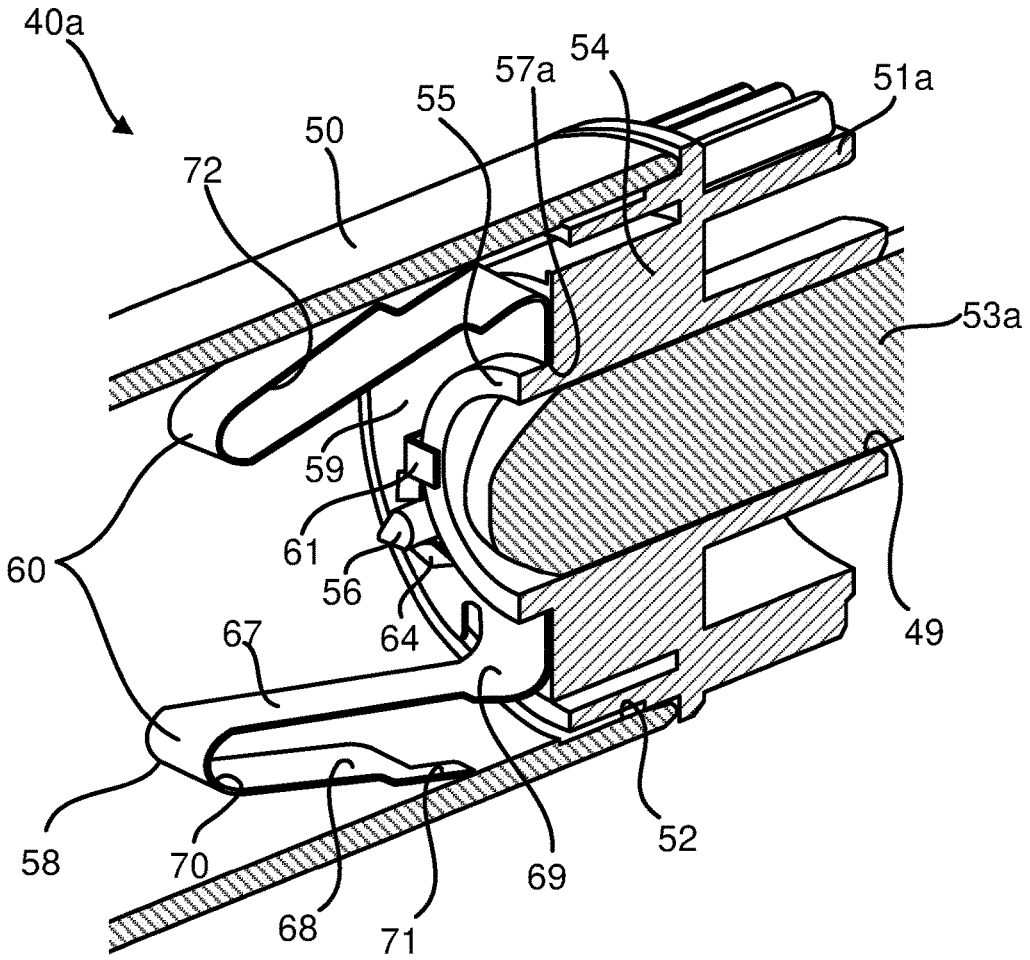
FIG. 4 is a perspective view showing a sectional plane of one end side of the drum unit cut along the center of a shaft member.
Figure 5A:
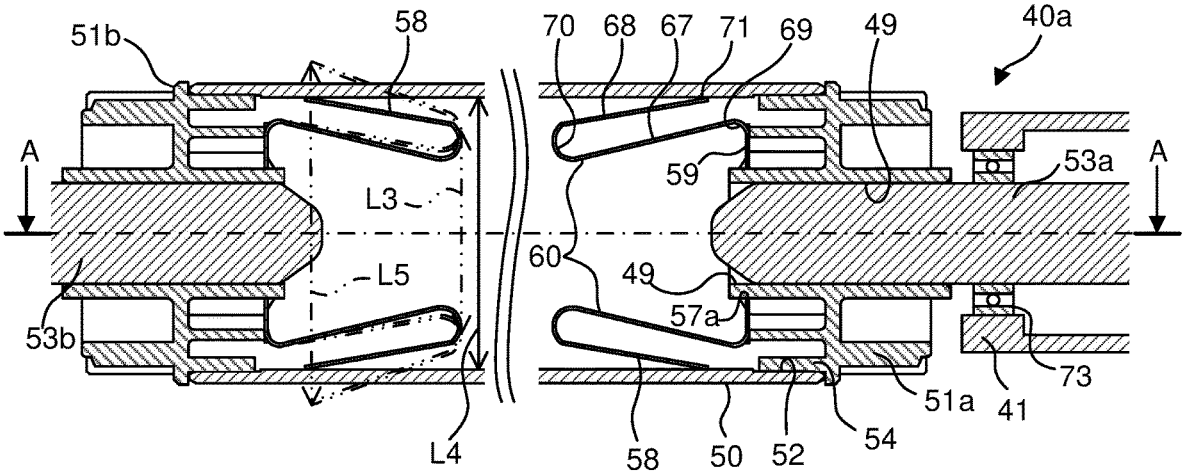
FIG. 5A is a sectional view of the drum unit cut along the shaft member.
Figure 5B:
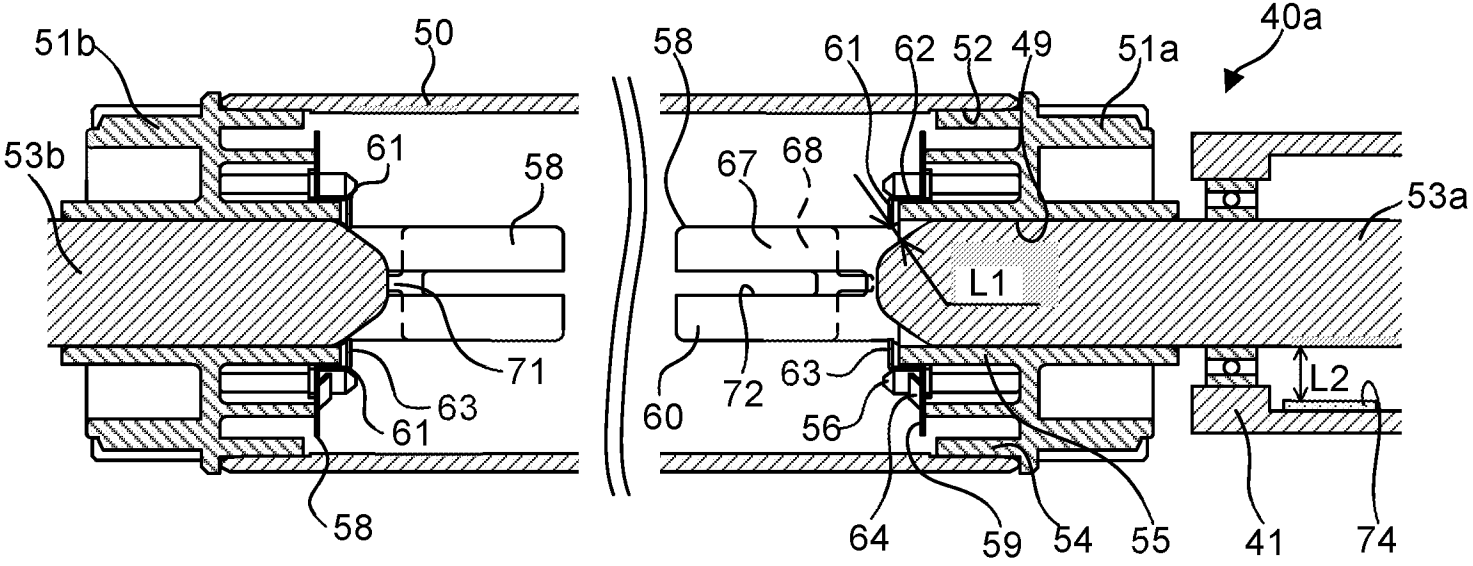
FIG. 5B is a sectional view of the drum unit cut along sectional plane A-A in FIG. 5A.
Figure 6:
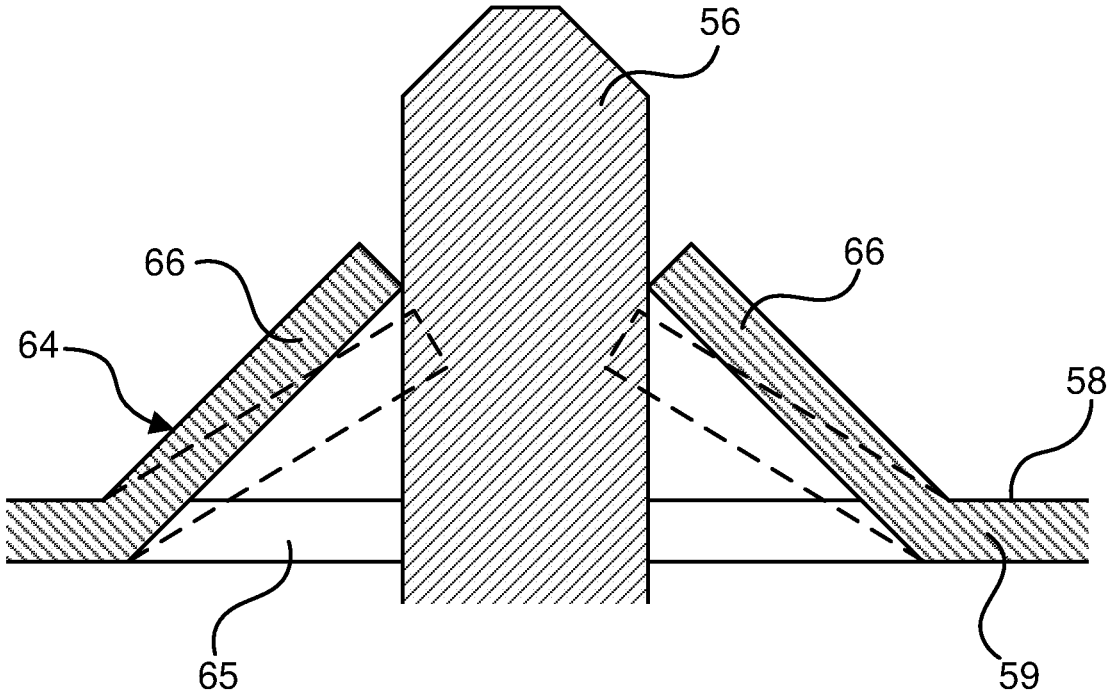
FIG. 6 is an enlarged sectional view around an engagement portion.

From one end side (the front-right side in FIG. 3) of the drum unit 40*a* protrudes also a toner discharge portion 43 of the cleaning device 7*a*. The waste toner collected off the surface of the photosensitive drum 1*a* by the cleaning device 7*a* is, as the collecting spiral 33 (see FIG. 2) rotates, discharged through the toner discharge portion 43 to be conveyed to a developer collecting container (not illustrated) .s FIG. 4 is a perspective view showing a sectional plane of one end side of the drum unit 40*a* cut along the center of the shaft member 53*a*. FIG. 5A is a sectional view of the drum unit 40*a* according to the first embodiment of the present disclosure, cut along shaft members 53*a* and 53*b*. FIG. 5B is a sectional view of the drum unit 40*a* cut along A-A sectional plane in FIG. 5A. FIG. 6 is an enlarged sectional view around engagement portions 64 provided in a grounding member 58. One end side and the other end side of the drum unit 40*a* are basically structured similarly. Accordingly, common features will be described only for one end side, and no overlapping description will be repeated for the other end side; for the other end side, only those features not found on one end side will be described.

As shown in FIGS. 4, 5A, and 5B, the photosensitive drum 1*a* has a drum body 50 (image carrying member), flange members 51*a* and 51*b*, and shaft members 53*a* and 53*b*. The drum body 50 has the shape of a hollow cylinder with openings 52 formed at opposite ends. The drum body 50 is a plain tubular drum of aluminum of which the outer circumferential surface is coated with a photosensitive layer. Used as the photosensitive layer is, for example, an OPC (organic photoconductor) layer using an organic photoconductor, or an inorganic photoconductive layer such as an amorphous silicon photoconductive layer formed by vapor deposition using silane gas.

The flange members 51*a* and 51*b* are round columnar members formed of an electrically non-conductive material such as resin. The flange members 51*a* and 51*b* are arranged one at each end of the drum body 50 in its axial direction. Specifically, the flange member 51*a* is arranged at one end side (the right side in the illustration), and the flange member 51*b* is arranged at the other end side (the left side in the illustration). The flange members 51*a* and 51*b* have a fitting portion 54 which is fitted in the opening 52 formed at each end of the drum body 50, and are penetrated by a through-hole 49 along the center axis of the drum body 50. The outer diameter of the fitting portion 54 is slightly larger than the inner diameter of the drum body 50. The flange members 51*a* and 51*b* are fixed to the drum body 50 as a result of the fitting portion 54 being press-fitted in the opening 52. The fitting portion 54 has a rib 55 which rises from the opening edge of the through-hole 49. In an end part of the fitting portion 54 in its fitting direction, a plurality of fixing projections 56 are provided that project in the fitting direction.

The shaft members 53*a* and 53*b* are formed of a metal material. The shaft members 53*a* and 53*b* are rotatably supported on bearings 73 provided on the unit housing 41 (see FIGS. 5A and 5B). The shaft members 53*a* and 53*b* are arranged respectively at opposite ends of the drum body 50. Specifically, the shaft member 53*a* is arranged at one end side (the right side in the illustration), and the shaft member 53*b* is arranged at the other end side (the lift side in the illustration).

The outer diameter of the shaft members 53*a* and 53*b* is equal to or slightly larger than the inner diameter of the through-hole 49 in the flange members 51*a* and 51*b*. The shaft members 53*a* and 53*b* are fixed to the flange members 51*a* and 51*b* by being press-fitted into the through-hole 49 in the flange members 51*a* and 51*b*. Thus the shaft members 53*a* and 53*b* rotatably support the flange members 51*a* and 51*b*.

The shaft member 53*b* provided at the other end side of the drum body 50 is connected to a grounding mechanism (such as a metal frame, not illustrated) provided in the body of the image forming apparatus 100 so as to be electrically grounded.

As shown in FIG. 5B, near the shaft member 53*a* at one end side of the drum body 50, a circuit board portion 74 is provided. The circuit board portion 74 is arranged inside the unit housing 41, and controls the rotation speed and the like of the photosensitive drum 1*a*.

As shown in FIGS. 4 and 5A, between the drum body 50 and the flange members 51*a* and 51*b*, the grounding member 58 is arranged, which is formed of an electrically conductive material such as metal. The grounding member 58 has a first bottom plate portion 59 and a pair of flat spring portions 60.

The first bottom plate portion 59 has the shape of a disk, and makes contact with an end part of the fitting portion 54 in its fitting direction The first bottom plate portion 59 has a pair of engagement portions 64 and a pair of first projection portions 61. At the center of the first bottom plate portion 59, an engagement hole 57*a* is formed that penetrates it along the center axis of the drum body 50.

The pair of engagement portions 64 faces each other in the radial direction across the engagement hole 57*a* (the engagement portions 64 at the other side are not illustrated). As shown in FIG. 6, the engagement portion 64 has a through-hole 65, which has a rectangular shape and which penetrates the first bottom plate portion 59, and a pair of engagement segments 66, which rises from edge parts of the through-hole 65 and which face each other in the circumferential direction of the engagement hole 57*a*. Each engagement segment 66 has the shape of a rectangular plate. The engagement segments 66 extend, while inclining, from edge parts of the through-hole 65 in the fitting direction (upward in FIG. 6).

In FIG. 6, broken lines indicate the engagement segments 66 in a state before the grounding member 58 is fixed to the fitting portion 54. In the state before the grounding member 58 is fixed to the fitting portion 54, the distance between tip end parts of the engagement segments 66 is smaller than the outer diameter of the fixing projection 56. When the grounding member 58 is fixed to the fitting portion 54, the fixing projection 56 is fitted into the through-hole 65 in the engagement portion 64. Meanwhile the fixing projection 56 is inserted between the pair of engagement segments 66 while pressing it apart. The pair of engagement segments 66 makes contact with the outer circumferential surface of the fixing projection 56, and with its restoring force presses the fixing projection 56 so as to pinch it in between. Thus the fixing projection 56 is held so as not to come off.

As shown back in FIGS. 5A and 5B, the pair of first projection portions 61 faces each other in the radial direction across the engagement hole 57*a*. The first projection portion 61 has an upright wall portion 62, which has the shape of a rectangular plate and which rises from the opening edge of the engagement hole 57*a* in the fitting direction, and a deflecting portion 63, which has the shape of a rectangular plate and which deflects from the tip end of the upright wall portion 62 toward the center of the engagement hole 57*a*. The upright wall portion 62 faces the outer circumferential surface of the rib 55 on the fitting portion 54 in the radial direction. The deflecting portion 63 faces the end surface of the rib 55 in the fitting direction.

As shown in FIG. 5B, the tip end of the deflecting portion 63 of the grounding member 58 arranged at the other end side (the left side in the illustration) of the drum unit 40*a* makes contact with the outer circumferential surface of the shaft member 53*b*.

On the other hand, the tip end of the deflecting portion 63 of the grounding member 58 arranged at one end side (the right side in the illustration) of the drum body 50 is away, across a predetermined distance, from the outer circumferential surface of the shaft member 53*a*. The distance L1 between the tip end of the deflecting portion 63 and the shaft member 53*a* at the position where they are closest to each other is smaller than the distance L2 between the circuit board portion 74 and the shaft member 53*a* at the position where they are closest to each other.

As shown in FIGS. 5A and 5B, the flat spring portions 60 rise from the outer circumferential edge of the first bottom plate portion 59 in the fitting direction (inward along the axial direction of the drum body 50). The pair of flat spring portions 60 faces each other in the radial direction. The flat spring portion 60 has a first spring segment 67 and a second spring segment 68.

The first spring segment 67 is a rectangular plate-shaped member that connects via a first bent portion 69 to the outer circumferential edge of the first bottom plate portion 59. The first spring segment 67 deflects via the first bent portion 69 from the first bottom plate portion 59 inward in the radial direction. In other words, the first spring segment 67 extends from the first bent portion 69 in the fitting direction so as to be increasingly inward in the radial direction. The first spring segment 67 is a flat spring that is elastically deformable in the radial direction about the first bent portion 69.

The second spring segment 68 is a rectangular plate-shaped member that connects via a second bent portion 70 to the tip end of the first spring segment 67. The second spring segment 68 deflects via the second bent portion 70 outward in the radial direction. In other words, the second spring segment 68 extends from the second bent portion 70 in the direction opposite to the fitting direction (i.e., as it approaches the first bottom plate portion 59) so as to be increasingly outward in the radial direction. The second spring segment 68 is a flat spring that is elastically deformable in the radial direction about the second bent portion 70. At the tip end of the second spring segment 68, a first contact segment 71 is provided that extends so as to be increasingly outward in the radial direction as it approaches the first bottom plate portion 59.

In FIG. 5A, dash-dot-dot lines indicate the grounding member 58 in a state before the flange member 51*b* is fitted in the drum body 50. In this state, the distance L3 between the second bent portions 70 is smaller than the inner diameter L4 of the drum body 50. In the same state, the distance L5 between tip end parts (first contact segments 71) of the second spring segments 68 is larger than the inner diameter L4 of the drum body 50.

As shown in FIGS. 4 and 5B, in the flat spring portion 60 is formed a slit 72 that extends from the tip end of the flat spring portion 60 in the fitting direction toward the first bottom plate portion 59. The slit 72 is formed by cutting away a part of the blade spring portion 60 from the tip end of the flat spring portion 60, that is, from near a tip end part of the second spring segment 68 located at the boundary between the first and second spring segments 67 and 68, then through the second bent portion 70, the second spring segment 68, and the first spring segment 67 up to near the first bottom plate portion 59.

Figure 7A:
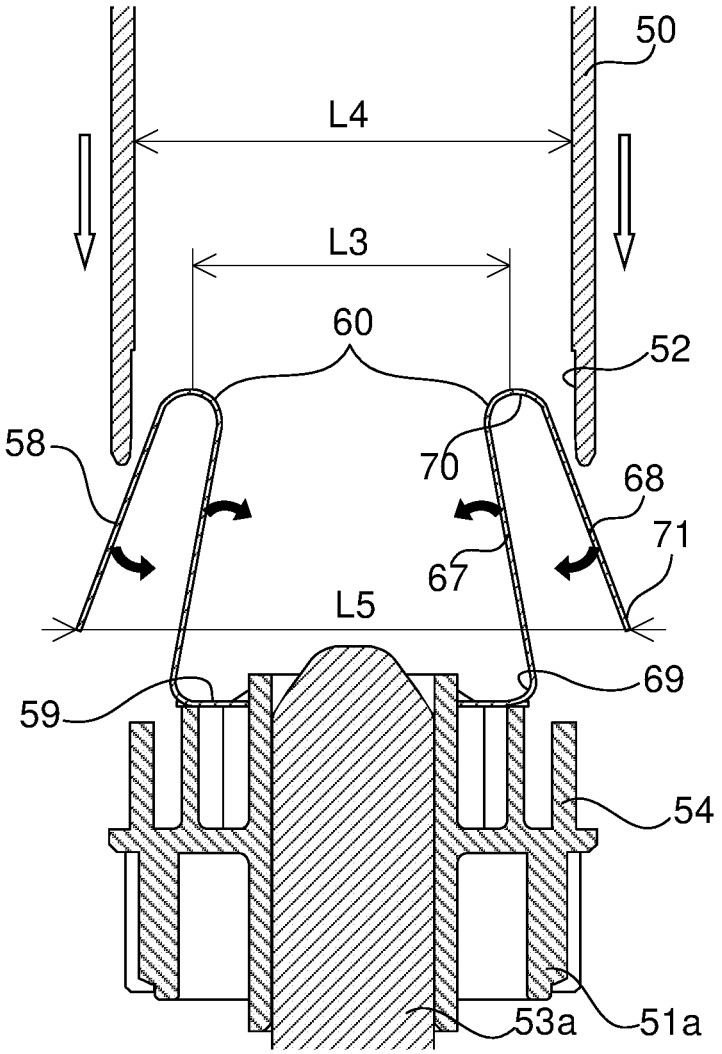
FIG. 7A is a sectional view showing a state before a flange member is fitted in a drum body.
Figure 7B:
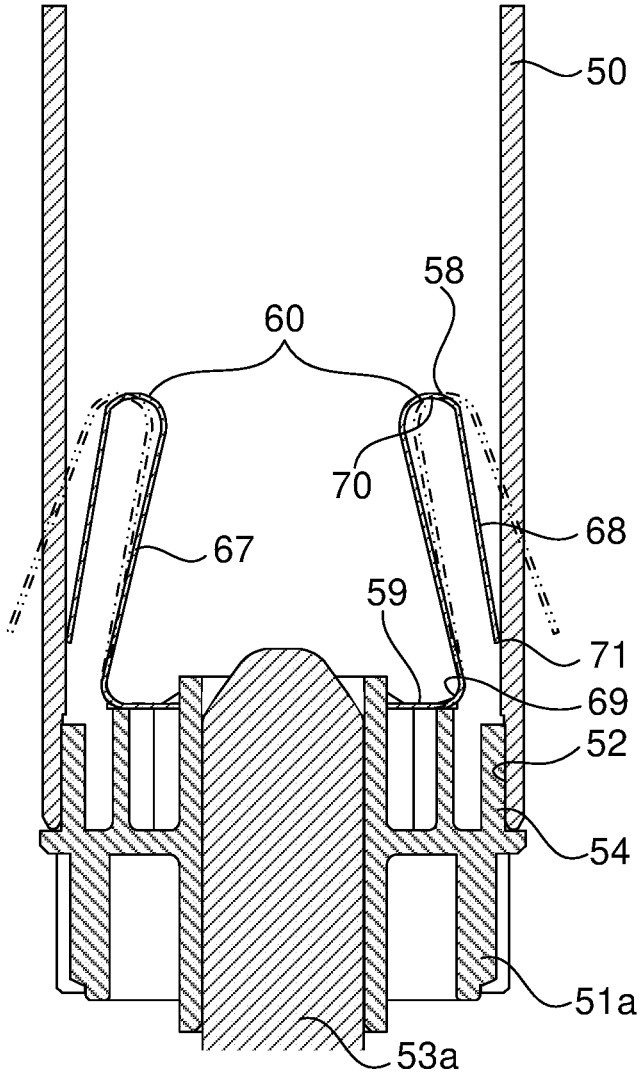
FIG. 7B is a sectional view showing a state after the flange member is fitted in the drum body.

Next, with reference to FIGS. 7A and 7B, how the relevant parts behave when the flange member 51*a* is fitted in the drum body 50 will be described in detail. FIG. 7A is a sectional view showing a state before the flange member 51*a* is fitted in the drum body 50. FIG. 7B is a sectional view showing a state after the flange member 51*a* is fitted in the drum body 50. In FIG. 7B, dash-dot-dot lines indicate the grounding member 58 in the state shown in FIG. 7A in a form overlaid on the grounding member 58 after the fitting of the flange member 51*a*.

The flange member 51*a* is fitted in the opening 52 in the drum body 50 as follows. First, the grounding member 58 is inserted into the drum body 50. Inserting the grounding member 58 up to a predetermined position inside the drum body 50 causes an end part of the drum body 50 in the fitting direction to make contact with the second spring segments 68. From this state, further inserting the grounding member 58 causes the pair of flat spring portions 60 to elastically deform inward in the radial direction. That is, the second spring segments 68 elastically deform in the radial direction about the second bent portions 70. The first spring segments 67 too elastically deform in the radial direction about the first bent portions 69. From this state, further inserting the grounding member 58 and press-fitting the fitting portion 54 of the flange member 51*a* in the opening 52 in the drum body 50 results in the flange member 51*a* being fixed to the end part of the drum body 50. With the flange member 51*a* fixed to the end part of the drum body 50, the second spring segments 68 are elastically deformed more than the first spring segments 67.

As described above, when the flange members 51*a* and 51*b* are fitted in the openings 52 in the drum body 50, while the flat spring portions 60 elastically deform inward in the radial direction, the first contact segments 71 make contact with the inner circumferential surface of the drum body 50. Thus the pressing force that the drum body 50 receives from the grounding member 58 is comparatively weak, and this helps suppress deformation of the drum body 50. It is thus possible to suppress image degradation.

Moreover, as mentioned above, in the state before the flange members 51*a* and 51*b* are fitted in the drum body 50, the distance L3 between the second bent portions 70 of the flat spring portions 60 is smaller than the inner diameter L4 of the drum body 50. Furthermore, since the first spring segments 67 and the second spring segments 68 elastically deform by making contact with an end part of the opening 52 in the drum body 50, inserting the grounding member 58 into the drum body 50 does not require a special tool or the like. It is thus possible to avoid complicating the assembly of the drum unit 40*a*.

Moreover, the flat spring portion 60 elastically deforms at two places, namely the first bent portion 69 and the second bent portion 70. Thus the effect of the deformation of the flat spring portion 60 is distributed between the two places, that is, the first bent portion 69 and the second bent portion 70, and this makes the first bottom plate portion 59, which is adjacent to the first bent portion 69, less likely to be affected by the deformation of the flat spring portion 60. Moreover, as mentioned above, with the flange member 51*a* fixed to the end part of the drum body 50, the second spring segment 68 elastically deforms more than the first spring segment 67. This makes the first bottom plate portion 59 less likely to be affected by the elastic deformation of the first spring segment 67, and it is thus possible to effectively suppress deformation around the first bent portion 69 of the first bottom plate portion 59. This helps keep the shaft members 53*a* and 53*b* and the grounding member 58 stably in a conducting state.

Incidentally, in general, the drum units 40*a* to 40*d* can be electrostatically charged inadvertently with static electricity or the like when a user touches them during maintenance. If the static electricity conducts to the circuit board portion 74 provided in the drum units 40*a* to 40*d*, the circuit board portion 74 may break down.

To cope with the problem, some known drum units have an electrically conductive needle-form member (conducting rod) as a means for eliminating electrostatic charge as mentioned above arranged at a position facing the drum body. The electrically conductive needle-form member is connected to a grounding mechanism provided in the image forming apparatus so as to be electrically grounded. The static electricity retained on the drum unit is discharged to the electrically conductive needle-form member, and this helps avoid break-down of the circuit board portion. Inconveniently, however, these known drum units require a structure for arrangement of an electrically conductive needle-form member, leading to an increased manufacturing cost.

By contrast, in the drum unit 40*a* according to the present disclosure, as described above, the first contact segments 71 of the grounding member 58 make contact with the inner circumferential surface of the drum body 50. Moreover, at the other end side of the drum unit 40*a*, the tip ends of the deflecting portions 63 of the first projection portions 61 of the grounding member 58 make contact with the shaft member 53*b*. The grounding member 58 and the shaft member 53*b* are both formed of an electrically conductive material, and the drum body 50 is electrically connected via the grounding member 58 to the shaft member 53*b* at the other end side. Thus the drum body 50 is electrically grounded via the grounding member 58 and the shaft member 53*b* at the other end side.

Moreover, the distance L1 between the tip ends of the deflecting portions 63 and the shaft member 53*a* at one end side at the position where they are closest to each other is smaller than the distance L2 between the circuit board portion 74 and the shaft member 53*a* at the position where they are closest to each other. Thus even if the shaft member 53*a* is electrostatically charged, the electric charge is discharged preferentially toward the deflecting portions 63 rather than toward the circuit board portion 74. In addition, as mentioned above, the drum body 50 is electrically grounded. Thus the electric charge discharged from the shaft member 53*a* to the deflecting portions 63 is diverted via the shaft member 53*b* at the other end side to the ground. It is thus possible to prevent break-down of the circuit board portion 74 as a result of electric current passing from the shaft member 53*b* at the other end side to the circuit board portion 74.

Figure 8:
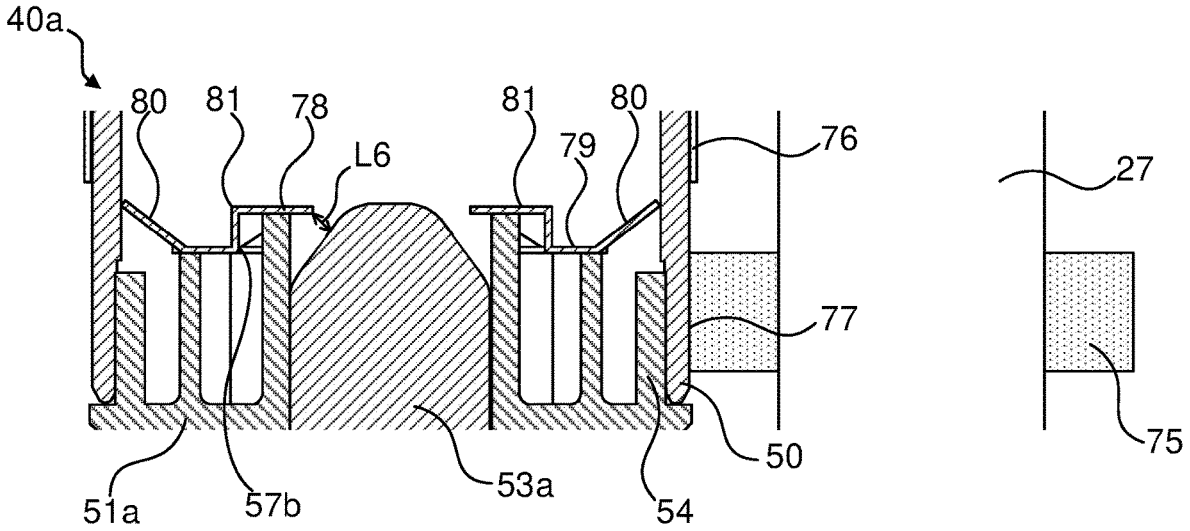
FIG. 8 is a sectional view around the other end side of a drum body of a drum unit according to a second embodiment.

Next, a drum unit 40*a* according to a second embodiment of the present disclosure will be described with reference to FIG. 8. FIG. 8 is a sectional view around one end part of the drum body 50 of the drum unit 40*a* of the second embodiment.

As shown in FIG. 8, a magnetic roller 27 is arranged opposite a drum body 50. On each end of the magnetic roller 27, a ring-shaped gap forming member 75 is provided. The outer circumferential surface of the gap forming member 75 makes contact with a non-image-formation region 77 located outward of a photosensitive layer 76 on the outer circumferential surface of the drum body 50. The gap forming member 75 keeps the magnetic roller 27 away from the drum body 50 such that a predetermined gap (clearance) is formed between the drum body 50 and the magnetic roller 27.

Between the drum body 50 and the shaft member 53*a* at one end side, a grounding plate 78 is arranged that is formed of an electrically conductive material such as metal. The grounding plate 78 has a second bottom plate portion 79, a pair of second contact segments 80, and a pair of second projection portions 81.

The second bottom plate portion 79 makes contact with an end part of the flange member 51*a* in the fitting direction. At the center of the second bottom plate portion 79, an engagement hole 57*b* is formed in which a shaft member 53*a* and a rib 55 on the flange member 51*a* is fitted.

The second projection portions 81 face each other across the engagement hole 57*b*. The second projection portions 81 rise from the second bottom plate portion 79 in the fitting direction, and extend so as to approach the shaft member 53*a*. The distance between the tip ends of the second projection portions 81 and the shaft member 53*a* at the position where they are closest to each other is smaller than the distance L2 (see FIG. 5B) between the circuit board portion 74 and the shaft member 53*a* at the position where they are closest to each other.

The second contact segments 80 extend from the outer circumferential edge of the second bottom plate portion 79 toward the inner circumferential surface of the drum body 50. The second contact segments 80 are arrayed in the radial direction across the engagement hole 57*b*. The tip ends of the second contact segments 80 make contact with the inner circumferential surface of the drum body 50 at such positions along the axial direction of the drum body 50 that overlap the non-image-formation region 77 but that do not overlap the gap forming member 75.

In a state before the grounding plate 78 is inserted in the drum body 50, the distance between the tip ends of the second contact segments 80 is larger than the inner diameter of the drum body 50. Thus, in the second embodiment, with the flange member 51*a* fitted in the drum body 50, the drum body 50 is pressed by the second contact segments 80 with a comparatively strong force. Here, as mentioned above, the positions in the axial direction of the drum body 50 at which the inner circumferential surface of the drum body 50 makes contact with the second contact segments 80 overlap the non-image-formation region 77 but do not overlap the gap forming member 75. Thus, even if, at those positions of contact, the drum body 50 deforms under the pressing force that it receives from the second contact segments 80, the photosensitive layer 76 is unlikely to be affected. Moreover, since those positions do not overlap the gap forming member 75, the rotation of the drum body 50 too is unlikely to be affected. It is thus possible to suppress image degradation.

The present disclosure is not limited by the embodiments described above and allows for any modifications without departure from its spirit. For example, the present disclosure finds applications not only in color printers like the one shown in FIG. 1 but in any other image forming apparatuses such as monochrome printers, monochrome and color copiers, and digital multifunction peripherals (furnished with multiple functions including copying, faxing, and scanning capabilities, also called MFPs).

The circuit board portion 74 does not need to be arranged near the shaft member 53*a*; it may be arranged, instead of on the unit housing 41, in the body of the image forming apparatus 100 for instance. Also in this construction, the distance L2 between the shaft member 53*a* and the circuit board portion 74 at the position where they are closest to each other is larger than the distance L1 between the shaft member 53*a* and the grounding member 58 at the position where they are closest to each other or the distance L6 between the shaft member 53*a* and the grounding plate 78 at the position where they are closest to each other.

A construction is also possible where the outer diameter of the shaft members 53*a* and 53*b* is equal to or slightly smaller than the inner diameter of the through-hole 49 in the flange members 51*a* and 51*b* and adhesive is applied between the outer circumferential surface of the shaft members 53*a* and 53*b* and the inner circumferential surface of the through-hole 49 to fix together the shaft members 53*a* and 53*b* and the flange members 51*a* and 51*b*.

Instead of a construction where, as described above, the flange members 51*a* and 51*b* are fixed to the shaft members 53*a* and 53*b*, a construction is also possible where the flange members 51*a* and 51*b* are arranged rotatably about the shaft members 53*a* and 53*b* inserted in the through-hole 49. In this construction, the shaft members 53*a* and 53*b* are fixed to the unit housing 41.

The present disclosure is applicable to image carrying member units that are mounted in image forming apparatuses. Based on the present disclosure, it is possible to provide image carrying member units that suppress image degradation and that suppress increases in manufacturing cost.

What is claimed is:

1. An image carrying member unit comprising:

an image carrying member in a cylindrical shape, the image carrying member having a photosensitive layer formed on an outer circumferential surface thereof, the image carrying member having an opening at each end thereof;

a flange member having:

a fitting portion fitted in the opening in the image carrying member; and a through-hole along a rotation center of the image carrying member, the flange member being electrically non-conductive and being fixed to each end of the image carrying member;

a shaft member inserted in the through-hole in the flange member; and a grounding member fixed to the flange member, the grounding member electrically connecting together the image carrying member and the shaft member, wherein the grounding member has:

a first bottom plate portion fixed to a tip end part of the fitting portion in a fitting direction thereof;

a pair of flat spring portions rising from the first bottom plate portion via a first bent portion in the fitting direction, the flat spring portions facing each other in a radial direction of the image carrying member, the radial direction being orthogonal to the fitting direction, the first bottom plate portion has:

a first projection portion extending toward the through-hole so as to approach and electrically connect to the shaft member, the flat spring portions each has:

a first spring segment extending from the first bent portion in the fitting direction; and a second spring segment bent from a tip end of the first spring segment via a second bent portion outward in the radial direction of the image carrying member to extend in a direction opposite to the fitting direction so as to approach the first bottom plate portion, before insertion in the image carrying member, a distance between the second bent portions of the flat spring portions is smaller than an inner diameter of the image carrying member and a distance between tip end parts of the second spring segments is larger than the inner diameter of the image carrying member.

2. The image carrying member unit according to claim 1, wherein the flat spring portions each have a slit extending from near a tip end part of the second spring segment through the second bent portion and the first spring segment to the first bottom plate portion.

3. An image forming apparatus comprising the image carrying member unit according to claim 2.

4. The image carrying member unit according to claim 1, wherein the flat spring portions each have a first contact segment extending from a tip end part of the second spring segment to make contact with an inner circumferential surface of the image carrying member.

5. An image forming apparatus comprising the image carrying member unit according to claim 4.

6. The image carrying member unit according to claim 1, wherein the grounding member is fixed to the flange member fixed to each end of the image carrying member, and a circuit board portion for controlling the image carrying member unit is arranged at one end side of the image carrying member, at the one end side of the image carrying member, a predetermined distance is provided between the shaft member fixed to the flange member and the first projection portion of the grounding member, at another end side of the image carrying member, the shaft member fixed to the flange member makes contact with the first projection portion of the grounding member, and a distance between the circuit board portion and the shaft member at a position where these are closest to each other is larger than a distance between the shaft member and the first projection portion.

7. An image forming apparatus comprising the image carrying member unit according to claim 6.

8. The image carrying member unit according to claim 1, further comprising:

a circuit board portion for controlling the image carrying member unit;

a grounding plate fixed to the flange member fixed to one end side of the image carrying member; and the grounding member fixed to the flange member fixed to another end side of the image carrying member, wherein the grounding plate has:

a second bottom plate portion fixed to an end part of the fitting portion in the fitting direction;

a second contact segment extending from the second bottom plate portion toward an inner circumferential surface of the image carrying member to make contact with the inner circumferential surface of the image carrying member at a position overlapping a non-image-formation region located outward of the photosensitive layer on the image carrying member in an axial direction thereof; and a second projection portion extending from the second bottom plate portion toward the shaft member to face the shaft member across a predetermined distance, at another end side of the image carrying member, the shaft member fixed to the flange member makes contact with the first projection portion, and at one end side of the image carrying member, a distance between the circuit board portion and the shaft member at a position where these are closest to each other is larger than a distance between the shaft member and the second projection portion.

9. An image forming apparatus comprising the image carrying member unit according to claim 8.

10. An image forming apparatus comprising the image carrying member unit according to claim 1.

11. The image forming apparatus according to claim 10, further comprising:

a developing roller arranged opposite the image carrying member and having a development region in which toner is supplied to the photosensitive layer; and a gap forming member provided in each end part of the developing roller in an axial direction thereof and making contact with the non-image-formation region on the image carrying member, wherein the grounding plate makes contact with an inner circumferential surface of the image carrying member at a position not overlapping the gap forming member in the axial direction.

* * * * *